United States Patent [19]

Bell

[11] Patent Number: 5,067,585

[45] Date of Patent: Nov. 26, 1991

[54] MULTIPURPOSE SAFETY AND POSITIONING BELT

[76] Inventor: Michael Bell, 1705 Triumphe Way, Warrington, Pa. 18976

[21] Appl. No.: 569,357

[22] Filed: Aug. 17, 1990

[51] Int. Cl.[5] ..... A62B 1/06; A62B 35/00

[52] U.S. Cl. ..... 182/7

[58] Field of Search ..... 182/8, 9, 5-7, 182/3

[56] References Cited

U.S. PATENT DOCUMENTS

| | | | |
|---|---|---|---|
| 3,022,855 | 2/1962 | Lewis | 182/3 |
| 3,165,168 | 1/1965 | Rose | 182/3 |
| 3,973,643 | 8/1976 | Hutchinson | 182/3 |
| 4,103,758 | 8/1978 | Himmelrich | 182/3 |
| 4,298,091 | 11/1981 | Anderson | 182/3 |
| 4,478,311 | 10/1984 | Anderson | 182/3 |
| 4,687,074 | 8/1987 | Green | 182/3 |

*Primary Examiner*—Reinaldo P. Machado

*Attorney, Agent, or Firm*—Caesar, Rivise, Bernstein, Cohen & Pokotilow, Ltd.

[57] ABSTRACT

A safety apparatus to be worn by a person located at an elevated position for releasable securement to a holding device, e.g., a rope grab, etc., to protect the person from falling. The apparatus also enables the person to move about relatively unencumbered when supported by it, while also enabling the person to repel down a safety line located adjacent the holding device. The apparatus comprises a first belt, a second belt, and a pair of extendable connecting straps. The first belt is releasably secured about the waist of the person and includes at least one connector, e.g., a D-ring, for releasable securement to the holding device. The second belt comprises an elongated web-like member having a pair of ends, each of which is fixedly secured to the first belt. The second belt is disposed in a stowed position interposed betweeen the first belt and the lower portion of the back of the person but is arranged to be pulled out and down from the first belt to form a seat for the buttocks of the person. Each of the extendable straps is fixedly secured to the second belt has a free end arranged to be readily connected to a lowering device mounted on the safety line to enable the person to repel down the line once he or she has disconnected the first belt from the holding device.

29 Claims, 3 Drawing Sheets

42
46
72
26S
56
66
28S
54
32
30
34
26S
56
26S
28S
74
66
50
48
74A
80
78
74B
38
56
60
28S
68
70
72B
72A
78
80

MULTIPURPOSE SAFETY AND POSITIONING BELT

BACKGROUND OF THE INVENTION

This invention relates generally to safety apparatus and more particularly to a belt apparatus arranged to be worn by a person and which performs various functions, namely, to prevent the person from falling from an elevated position, to suspend the person in a manner enable the person to perform some activity while so suspended and without interference by the apparatus, and to enable the person to readily connect himself/herself to repelling means to repel to a lower elevation.

As a result of the enactment of various safety laws persons working at elevated height positions, e.g., window washers, telephone lineman, etc., are required to be protected against falls. One common approach to achieve that end is the use of a safety belt which is worn on the worker's waist. The belt is arranged to be worn about the waist of the workman and includes a D-ring or some other metal loop fixedly mounted on the belt in the center of the portion located at the worker's back. The D-ring is arranged to be "tied off" i.e., connected, via a lanyard or some other means, to a supporting member, e.g., a portion of a building or other static structure, a rope grab device mounted on a safety line, etc. Thus, once the worker is tied off should he/she fall off of the platform, scaffolding, or other support on which he/she is working or if that platform etc. itself drops or otherwise falls away, the worker will be prevented from falling to the ground.

While such safety belts are generally suitable for their intended purposes they are not designed to act as a primary means for suspending the person at an elevated position to enable him/her to perform some activity while so suspended. In fact such safety belts are generally incapable of such use since they tend to inhibit the person's mobility, thus interfering with the worker's ability to function efficiently when he/she is tied off. Accordingly, so-called "positioning belts" were developed for applications wherein worker is to be suspended by the belt and where some mobility is necessary, e.g., for performing electrical, carpentry, etc., work on a construction project. As is known a "positioning belt" typically comprises an assembly of two "belts", with one "belt" located within the other. In particular such belts comprise a main belt which is arranged to be worn about the waist of the worker and which includes means, e.g., a pair of D-rings which may be adjustible, mounted on the assembly adjacent each hip, for connection to some fixed support structure for suspending the worker or to some "tie-off" means, e.g., a lanyard and associated rope grab for protecting the worker from falling. Located within the main belt is a second "belt". This second belt is actually an elongated, strap-like, member having a pair of ends which are fixedly secured to the main belt adjacent each hip, and is normally stowed away between the main belt and the back of the wearer. The second ("positioning") belt is arranged to be pulled out and down from the main belt to form a seat for the worker's buttocks. When so "positioned" the worker is supported in a seat like assembly which enables him/her to work in a comfortable, safe and efficient manner.

While such prior art positioning belts fulfill their intended suspension function without impairing the mobility of the wearer, they too provide less than optimum functionality. In this regard such belts lack safety means, e.g., a D-ring mounted on the rear of the main belt, as mandated by federal law for tie-off (fall protection) purposes, although the D-rings mounted on the assembly adjacent the wearer's hips for suspension purposes may serve as some means to tie the belt off. Moreover, prior art positioning belts, even when configured with hip-located D-rings are not conducive to be readily disconnected from the means to which they are connected to enable the positioning belt to be connected to a lowering or repelling device to enable the worker to readily repel or lower himself/herself to the ground via a safety line.

Examples of lowering or repelling devices are found in U.S. Pat. Nos. 3,220,511 and 3,250,515. Moreover, some such devices are commercially available. One particularly effective device for controlled lowering purposes is the SKY GENIE device sold by Descent Control, Inc. of Fort Smith, Arkansas.

The ability to be tied-off at an elevated position by being connected to a rope grab, or other suitable device, while enabling the ready disconnection therefrom and concomitant connection to a lowering or repelling device is of considerable importance from a safety standpoint and is the subject of my prior inventions. Those inventions are disclosed and/or claimed in my copending U.S. Pat. application Ser. Nos. 07/466,898 and 07/533,610, filed on Jan. 18, 1990 and June 5, 1990, and entitled Fall Prevention and Lowering System and Methods of Use, and Safety Harness, respectively.

OBJECTS OF THE INVENTION

Accordingly, it is a general object of this invention to provide a safety and positioning belt device which overcomes the disadvantages of the prior art.

It is a further object of this invention to provide a safety and positioning belt device which is configurable for protecting a person located at elevated positions from falling, for suspending a person at an elevated position while enabling the person to perform some activity thereat without interference, and for enabling the person to repel down to a lower position when desired.

It is still a further object of this invention to provide a safety and positioning belt having repelling means for ready connection to a lowering device.

It is yet a further object of this invention to provide a safety and positioning belt having storable repelling straps for ready extension from a stowed position to an extended position at which they may be connected to a lowering device.

SUMMARY OF THE INVENTION

These and other objects of this invention are achieved by providing a safety apparatus to be worn by a person located at an elevated position for releasable securement to a fixed means, e.g., a rope grab, located adjacent that position to protect the person from falling and/or to suspend the person therefrom. The apparatus also enables the person to move about relatively unencumbered by the apparatus, while also enabling the person to readily connect him/herself to a lowering device mounted on an adjacent safety line to repel down that line. The apparatus basically comprises first belt means, second belt means, and repelling device connection means for releasable securement to a lowering device mounted on the safety line. The first belt means is arranged to be releasably secured about the waist of the person and includes first connection means for releasable securement to the fixed means. The second belt means comprises an elongated web-like member having a pair of ends, with each of the ends being fixedly secured to the first belt means at respective spaced positions therealong. The second belt means is disposed in a stowed position interposed between the first belt means and the lower portion of the back of the person. The second belt means is arranged to be pulled down and out from the first belt means to an extended position to form a seat for the buttocks of the person. The connecting means comprises a pair of extendable, elongated strap-like members being fixedly secured to one of the belt means at a respective positions thereon adjacent the person's hips. Each of the strap-like members has a free end arranged to be readily connected to the lowering device for enabling the person to repel down said safety line once the person has disconnected the first belt means from the holding device.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figure 1:
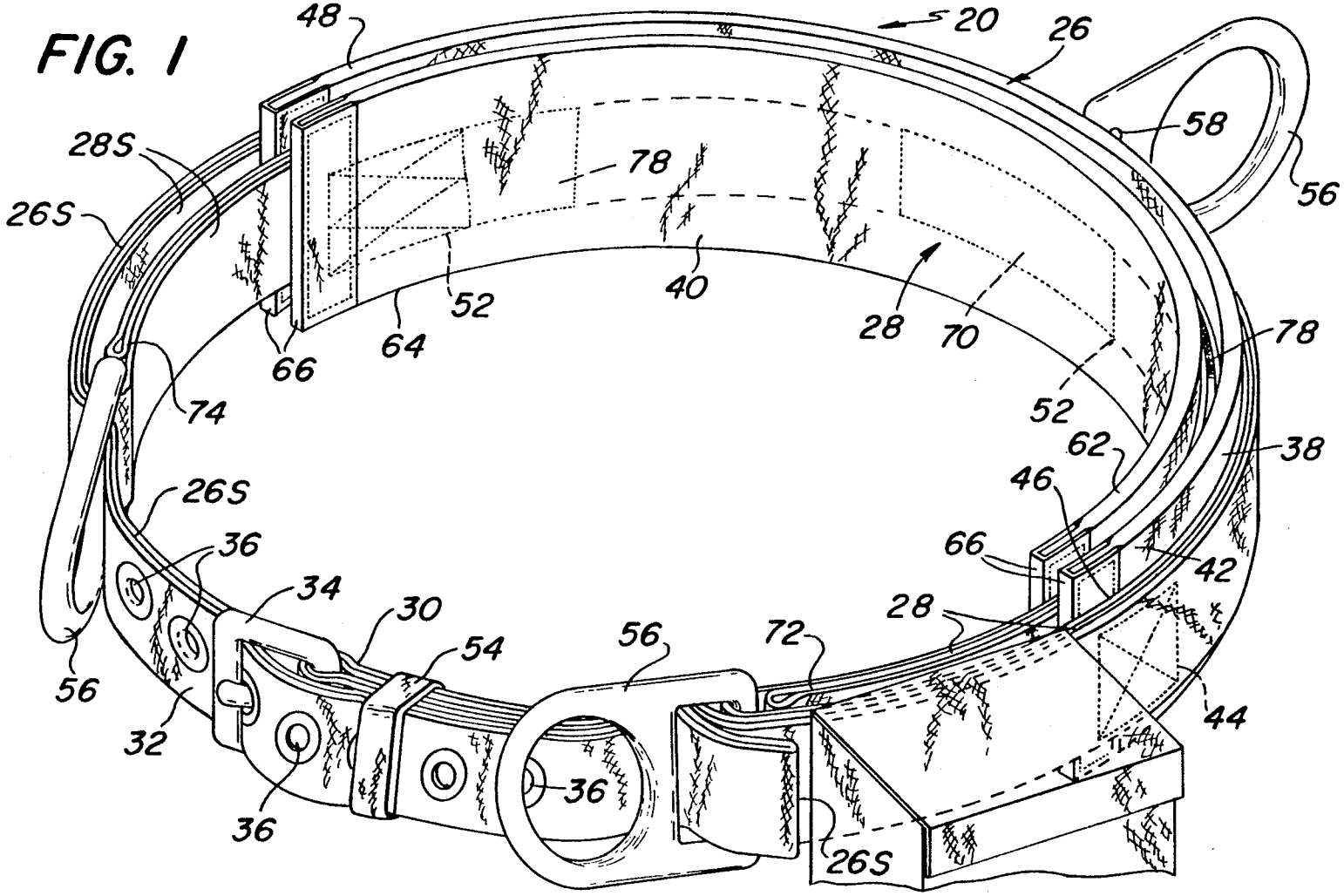
FIG. 1 is an orthogonal view of a safety apparatus constructed in accordance with this invention and shown as it is worn by a person (not shown) with its "positioning" means stowed away.

Referring now to the various figures of the drawings wherein like reference numerals refer to like parts, there is shown at 20 in FIG. 1, a safety apparatus constructed in accordance with this invention. The apparatus 20 is arranged to be worn about the waist of a person to serve as a safety and positioning belt. In particular the apparatus is arranged to be connected such as by a lanyard (not shown), to a conventional holding device, e.g., a "rope grab", (not shown) to prevent the person from falling if the person is working at an elevated position. In addition, the apparatus includes an assembly, to be described later, which is arranged to be deployed (extended) by the user to serve as a seat for him/her. Thus, the apparatus 20 when so deployed enables the person to be suspended by the apparatus 20 from some fixed means (not shown) to perform some work, e.g., electrical work, carpentry, etc., substantially unencumbered by the apparatus. Moreover, and quite significantly, as clearly shown in FIG. 2 the apparatus 20 includes repelling connection means (also to be described in considerable detail later) to enable the apparatus to be readily connected to any conventional lowering device, such as the heretofore identified SKY GENIE device 22, which is mounted on a vertically oriented safety line 24 located adjacent the position of the person.

Figure 2:
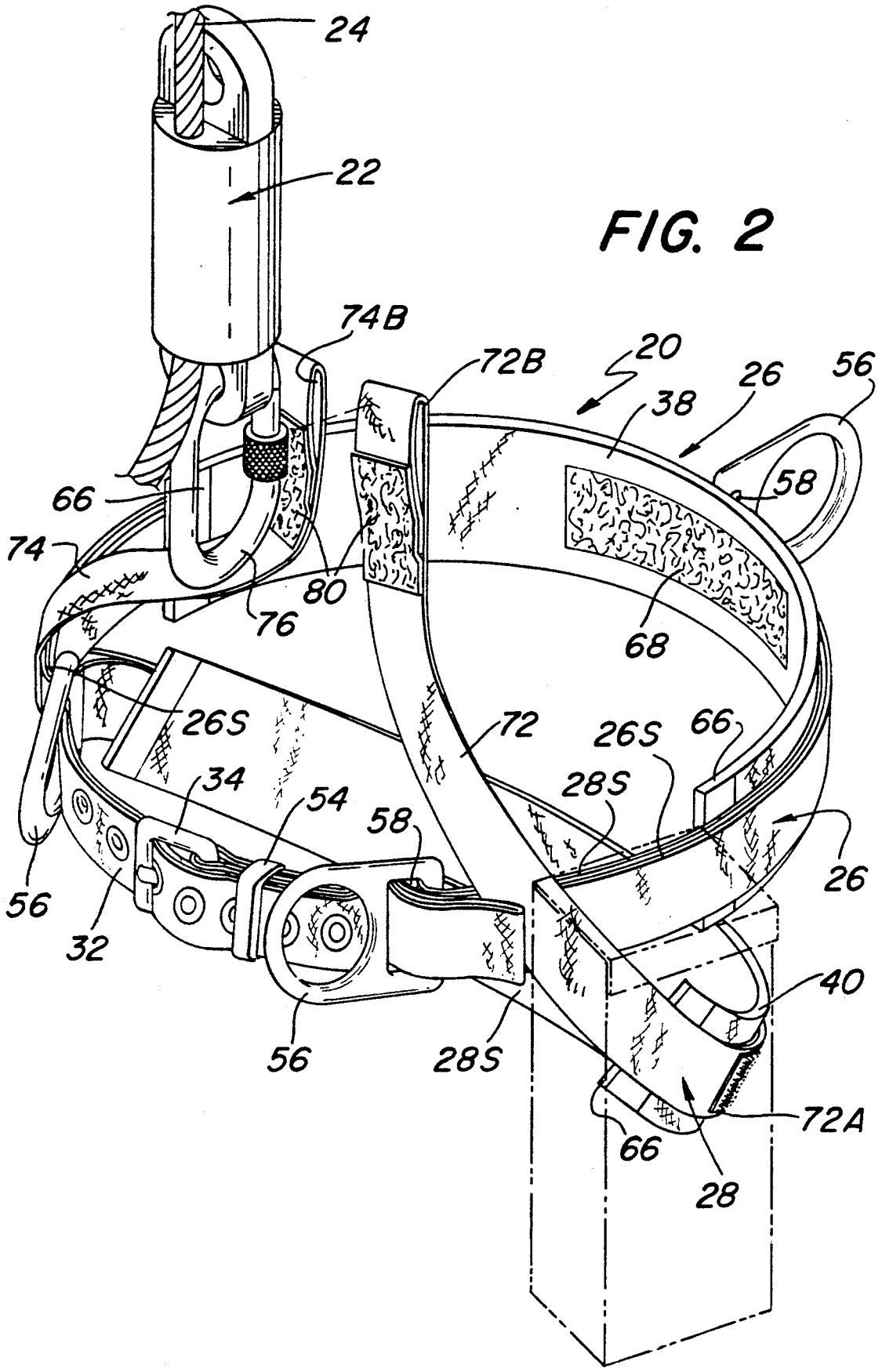
FIG. 2 is an orthogonal view of the safety apparatus shown in FIG. 1 with its "positioning" means extended in a typical manner of use to serve as a seat for the person wearing the apparatus.

Thus, as can be seen in FIGS. 1 and 2, the safety apparatus 20 basically comprises a main belt assembly 20 and a support or seat belt assembly 28. The main belt assembly is in the form of a strap or web 26S of a woven, high strength material, e.g., nylon or polyester. Preferably the web 26S is of double thickness for increased strength. Those two thicknesses are sewn together. The web 26S also includes a pair of ends 30 and 32 which are arranged to be releasably secured together to hold the apparatus 20 about the waist of the user. Thus, a conventional buckle 34 is mounted at end 30. A plurality of metal-lined eyelets 36 are disposed at equidistantly spaced positions in the end 3 of the web 26S.

The main belt assembly 26 also includes a pad 38 formed of a woven material of greater width that the web 26S. The pad 38 is fixedly secured to the web 26S on the inside surface thereof to bear on the small of the wearer's back to dissipating the load thereacross.

The "seat" assembly 28 will now be described. As will be seen that assembly is normally maintained in a retracted or stowed position wherein it is located within the main belt assembly 26 between that assembly and the person's back. The seat assembly is arranged to be deployed to an extended position, like that shown in FIG. 2, to form a support or seat for the person's buttocks so that the person may be suspended by the assembly 20 from any fixed means. When so suspended the person can move about substantially unencumbered by the apparatus. Thus the apparatus enables the person to perform activities while suspended.

The seat assembly 28, like the main belt assembly 26, is in the form of a web or strap 28S of a woven, high strength material, e.g., nylon or polyester. Preferably, that material is the same material as that making up the web 26S, except that the web 28S is only of single thickness. Like main belt assembly 26, the seat assembly also includes a pad of woven material, designated by the reference numeral 40, mounted thereon. The pad 40 serves as the seat on which the person's buttocks are disposed. Since the pad is wider than the web **28*s*** it dissipates the load to support the person comfortably thereon.

Both pads 38 and 40 are fixedly secured to their associated webs 26S and 28S, respectively, by stitching. In particular, as can be seen clearly in FIG. 1, one end of the main belt pad 38 is sewn at 44 to the main belt web 26S and to an interposed portion 46 of the web 28S of the seat assembly 28. The other end 48 of the main pad 38 is coupled to the web 26S of the main belt assembly 26 for a sliding movement with respect thereto. To that end, the end 48 of the main pad 38 includes a transverse mounted loop 50 (see FIG. 3) which is fixedly mounted thereon. The loop 50 is formed of a strong material, e.g., rubberized fabric, and forms a passageway through which the end 3 of the main belt web 26S passes freely. Only one end of the pad 38 of the main belt assembly is fixedly secured, e.g., sewn, to the main belt web 26S and with the other end of the pad having the rubberized loop 50 thereon through which the opposite end of the main belt web 26S passes freely. The seat belt pad 40 is fixedly secured along its length to the outer surface of the seat belt assembly web 28S by plural stitch lines 52.

As can be seen in FIG. 1 a loop 54 of a strong material, e.g., rubberized fabric, is disposed about the end 30 of the main belt assembly web 26S immediately adjacent the buckle 34. This loop serves as the means for holding the free end 32 of the seat belt assembly web 26S in place beyond the buckle. The free end 32 of the web 26S also extends through a slot, to be described later, in a conventional D-ring which is mounted on the apparatus 20, as will be described later.

Figure 3:
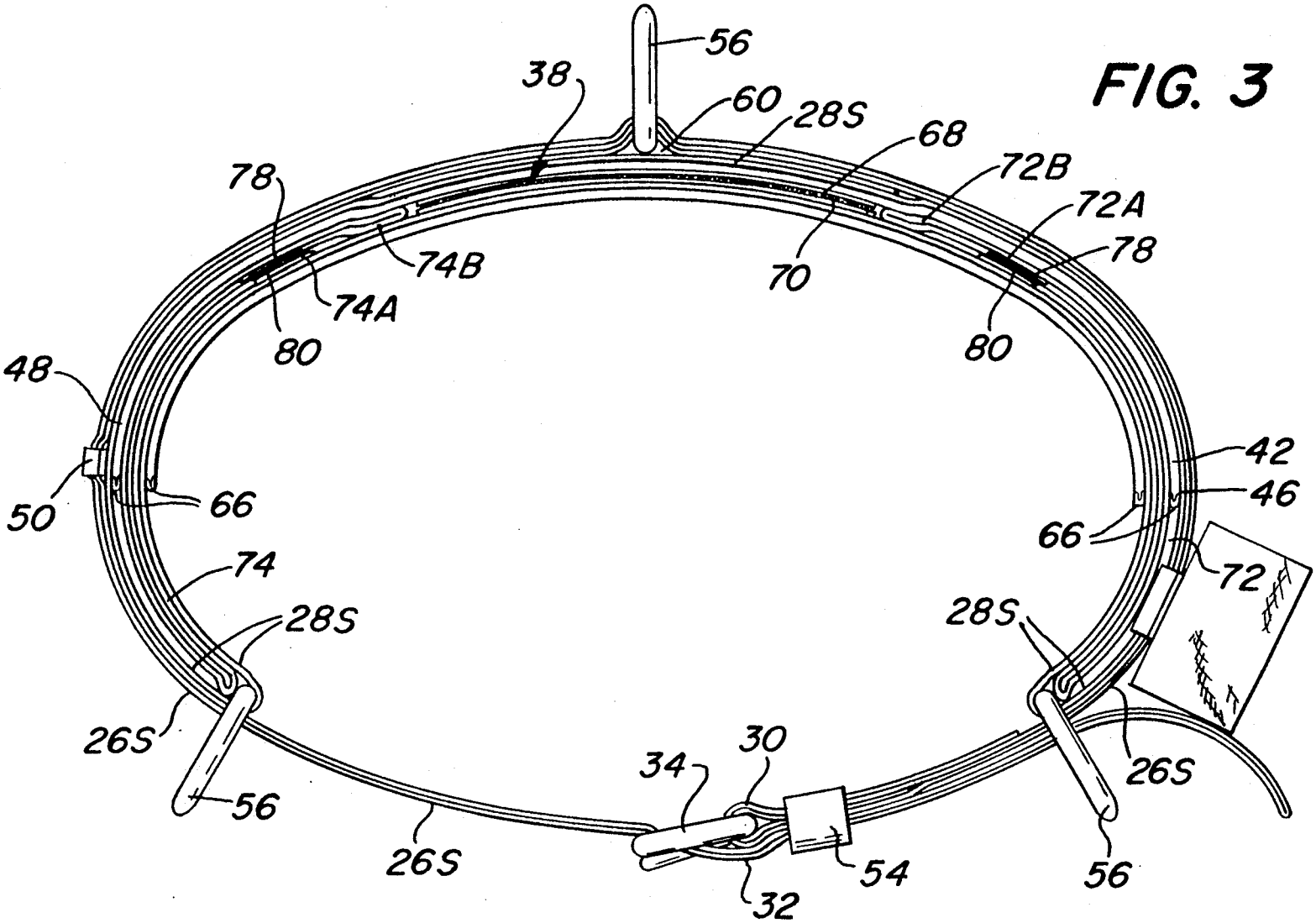
FIG. 3 is a reduced, top plan view of the safety apparatus shown in FIG. 1.

In order to provide means for connecting the safety apparatus 20 to some tie-off means, e.g., a lanyard and associated rope grab (not shown), a conventional D-ring 56 is fixedly mounted on the main belt assembly 26 at the center of the back of its pad 38. The D-ring 56, being of conventional construction, includes a transversely extending slot 58. This slot serves as the means to secure the D-ring to the main belt assembly 26. In particular, as can be seen in FIG. 3, a short strip 60 of the same material forming the web 26S extends through the slot 58 of the D-ring 56 and is fixedly secured on either side thereof, such as by stitching, to the outer surface of the web 28S making up the seat assembly 26. Accordingly, the D-ring is fixedly secured to the main belt assembly pad 38, but is free to pivot about an axis parallel to the slot 58 to facilitate the connection of the safety apparatus to the tie-off means.

The safety apparatus 20 also includes two other identically constructed D-rings 56. These rings are located adjacent the wearer's hips and to some means for suspending the apparatus and the person wearing it so that the person may perform any activity desired. Thus, a second D-ring 56 is mounted on the web 28S of the seat assembly 28 between the end 42 of the main belt assembly pad 38 and one end 62 of the seat assembly pad 40. In particular, that portion of the web 28S passes through the slot 58 in the D-ring 56. In a similar manner a third D-ring 56 is mounted on the web 28S of the seat assembly between the opposite end 48 of the main belt assembly pad 38 and the opposite end 64 of the seat assembly pad 40.

As can be seen clearly in FIG. 1, the free end portion 32 of the main belt web 26S extends through the slots 58 in each of the two D-rings 56. As can also be seen in that figure the ends of each of the pads 38 and 40 are reinforced with a vinyl coated fabric end cap 66 sewn thereon. The end caps 66 serve to prevent the ends of the pads from fraying.

As mentioned earlier, the seat assembly 26 is arranged to be maintained in a stowed position when it is not needed. In order to insure that the seat assembly does not slip out from between the main belt assembly and the wearer's back, releasable fastening means are provided. Those fastening means preferably comprise VELCRO fastening members located at the interface of the main belt assembly and seat assembly. In particular, as can be seen clearly in FIG. 2, an elongated patch 68 of a multi-loop component of the VELCRO fastening system is fixedly secured, i.e., sewn, onto the inner surface of the main belt assembly pad 38 at the center thereof. A cooperating patch 70 of the multi-loop component of the VELCRO fastening system is fixedly secured, i.e., sewn, onto the outer surface of the seat assembly web 28S, which is in turn fixedly secured to pad 40 at the central portion thereof. The patches 70 and 68 are arranged to cooperate with each other when the seat assembly is in the stowed position to hold it in place. When it is desired to deploy the seat assembly, all that is required is to separate the two patches 68 and 70 by pulling them apart. Then one pulls downward and outward on the seat assembly 28 to move it to the deployed or extended position like that shown in FIG. 2.

Once so deployed the belt apparatus 20 serves as a conventional positioning belt, i.e., the main pad 40 serves as a support for the buttocks of the user while the main pad 38 supports the person's back. The resulting structure acts like a seat wherein the person is supported from underneath and can lean back. This arrangement insures that the person may work comfortably at elevated positions for substantially long periods of time.

As mentioned earlier the belt apparatus 20 is arranged to be connected, when desired, to some means for enabling the person to repel downward from an elevated position. In the embodiment shown herein a lowering device 22 is provided for that purpose and is shown mounted on the vertically extending safety line 24, as is conventional. The means for connecting the safety apparatus 20 to the lowering device 22 basically comprises a pair of extendible repelling straps 72 and 74.

Each strap 72 and 74 is formed of the same material as that forming the webs 26S and 28S and is of approximately the same thickness and width. One end 72A of the strap 72 is fixedly secured, i.e., sewn, to one end of the outer surface of the seat assembly pad 40, while the corresponding end 74A of the strap 74 is similarly secured to the outer surface at the opposite end of the pad. The opposite ends of the straps 72 and 74 are initially (normally) held in a retracted or stowed position but are arranged to be extended outward and upward for connection to the lowering device, as will be described hereinafter. To that end, as can be seen, the free ends of the strap 72 and 74 are folded over and sewn in place to form respective closed loops 72B and 74B. Each loop 72B and 74B is arranged, when its associated strap is extended, such as shown in FIG. 2, to be connected, via any suitable connecting member to the lowering device 22. In the embodiment shown in FIG. 2, a conventional carabiner 76 mounted on the lowering device 22. The carabiner is openable so that each of the loops 72B and 74B may be inserted therein and the carabiner closed to look the loops in place therein on the lowering device.

As mentioned earlier in order to prevent the extendible strap members 72 and 74 from flapping about (and possibly interfering with the activities of the wearer of the belt apparatus 20, or otherwise causing a potential snagging hazard), the extendable repelling straps 72 and 74 are arranged to be normally held in a stowed position on the seat assembly 28. By "stowed" it is meant that the straps 72 and 74 are each folded over themselves so that the folded straps lay flat between the contiguous portions 28S of the seat assembly 28. As further mean for insuring that the repelling straps 72 and 74 do not accidentally fall out from the stowed position, releasable securement means, such as VELCRO fasteners, are provided on the extendable members 72 and 74. To that end a patch 78 of a multi-loop VELCRO component is secured, i.e., sewn, on the seat assembly web 28S immediately adjacent the end 72A of the repelling strap 72. In a similar manner an identical patch 78 is secured onto the seat assembly web 28S immediately adjacent the end 74A of the repelling strap 74. A patch 80 of the multi-loop VELCRO component is fixedly secured, i.e., sewn, onto the loop end 72B of the strap 72 while an identical patch is similarly secured on the loop end 74B of the strap 74. Thus, when the repelling straps 72 and 74 are in the stowed position, the patches 80 and 78 associated with strap 72 engage each other to hold the strap in place in the folded or stowed orientation, while the patches 78 and 80 associated with strap 74 perform the identical action for that strap. The use of VELCRO fasteners for holding the extendable strap 72 and 74 in place is merely exemplary of any type of releasable securing means which can be used for that purpose. Irrespective of the type of releasable securement means used, the use of such means is of considerable importance to ensure that the repelling straps are held flat against the seat assembly and do not flap about loosely when the seat assembly 28 is deployed inasmuch as those straps will no longer be interposed between the seat assembly and the main belt assembly at that time.

When it is desired to extend the repelling straps 72 and 74 for connection to the lowering means 22 all that is required is for the user to grasp the free ends 72B and 74B of the straps 72 and 74, respectively, to separate their respective patches 78 and 80 and thereby move the straps 72 and 74 into the position shown in FIG. 2 for connection to the carabiner 76.

When the safety apparatus 20 is no longer needed to be used its various components can be resecured readily so that the belt is in its state, like that shown in FIG. 1 ready for reuse.

As can be seen in FIG. 1 the safety apparatus 20 includes a holster or pouch 100 which is mounted on the web 26S adjacent one of the D-rings 56 to be readily accessible by the user. The holster 100 is preferrably releasably secured to the belt web 26S by sliding it thereon. In this regard the rear side of the holster includes a pair of slots through which the web 26S extends. Alternatively, the holster may be releasably secured, e.g., via VELCRO fasteners, to the web 26S. In fact, if desired the holster may be fixedly secured, e.g., sewn, to the belt web 26S.

In any event the holster 100 is a member having plural walls formed of any suitable material, e.g., leather, nylon, rubberized fabric, plastic, to form a hollow interior space or cavity which is arranged to store desired components, e.g., a lowering device 22, or tools, e.g., a knife, screw driver, etc., therein. In order to ensure that the items disposed within the holster do not fall out the holster includes a moveable flap 102 disposed over its hollow interior to close the interior. The flap 10 is arranged to be held in place closing the holster via releasable fastening means, e.g., VELCRO fasteners.

It should now be appreciated by those skilled in the art that the subject belt apparatus is a multi-function device. In this regard it can be used in a manner similar to use as conventional safety belt (e.g., it can be used to tie off the person via the use of the D-ring located on the rear of the main belt), in a manner similar to use as a conventional positioning belt (e.g., it can be used as a suspended seat via the use of the two hip-located D-rings when the seat assembly is deployed), and, quite significantly, as means for enabling a person to repel down a safety line from an elevated position (i.e., via the extendable repelling straps, all without compromising the ability of the belt to perform those respective functions. Moreover, the device is simple in construction and arranged to be stowed in a compact state such that it does not interfere with the wearer's activities.

Without further elaboration the foregoing will so fully illustrate my invention that others may, by applying current or future knowledge, adopt the same for use under various conditions of service.

I claim:

1. Safety apparatus to be worn by a person located at an elevated position for releasable securement to a fixed means located adjacent said position to protect the person from falling and/or suspend said person thereat, while enabling said person to move about relatively unencumbered by said apparatus and also enabling said person to connect said apparatus to a lowering device mounted on an adjacent safety line to repel down said line, said apparatus comprising first belt means, second belt means, and lowering device connection means, said first belt means being arranged to be releasably secured about the waist of the person and including first connection means for releasable securement to said lowering device, said second belt means comprising an elongated web-like member having a pair of ends, each of said ends being fixedly secured to said first belt means at respective spaced positions, said second belt means being disposed in a stowed position interposed between said first belt means and the lower portion of the back of said person, said second belt means being arranged to be pulled down and out from said first belt means to an extended position to form a seat for the buttocks of said person, said lowering device connecting means comprising a pair of extendable, elongated strap-like members being fixedly secured to one of said belt means at a respective positions thereon adjacent the person's hips, each of said strap-like members having a free end arranged to be readily connected to said lowering device for enabling said person to repel down on a safety line once said person has disconnected said first belt means from said holding device.

2. The safety apparatus of claim 1 wherein said extendable, elongated strap like members are initially held by first releasable securement means in a storage position on said apparatus until it is desired to connect said strap-like members to said lowering device, whereupon each of said members may be readily moved to an extended position so that the free ends thereof may be connected to said lowering device.

3. The safety apparatus of claim 2 wherein said first releasable securement means comprises a fastening system having at least one hook component and at least one loop component, with one component of said system being secured to the free end of each strap and with the other component being secured to said second belt means, said components being arranged to engage each other to hold the free end of each of said elongated strap-like members against said second belt means, thereby preventing said strap-like members from interfering with the activities of said person when said strap-like members are in the storage position.

4. The safety apparatus of claim 1 wherein said first connection means comprises at least one D-ring.

5. The safety apparatus of claim 2 wherein said first connection means comprises at least one D-ring.

6. The safety apparatus of claim 1 wherein said D-ring is secured to said first belt means at a central position with respect to the back of said person when said apparatus is worn by said person.

7. The safety apparatus of claim 1 wherein said first belt means includes adjustment means to adjust the size of said belt means to fit various sized waists.

8. The safety apparatus of claim 6 wherein said first belt means includes adjustment means to adjust the size of said belt means to fit various sized waists.

9. The safety apparatus of claim 1 wherein said first and second belt means are each formed of a flexible fabric material.

10. The safety apparatus of claim 9 wherein said fabric material is nylon or polyester.

11. The safety apparatus of claim 9 wherein the free end of each of said strap-like members are folded back over to form a loop at said free end for connection to said lowering device.

12. The safety apparatus of claim 11 wherein said strap-like members are initially held by first releasable securement means in a storage position on said apparatus until it is desired to connect said strap-like members to said lowering device, whereupon each of said members may be readily moved to an extended position so that the free ends thereof may be connected to said lowering device.

13. The safety apparatus of claim 12 wherein said first belt means includes adjustment means to adjust the size of said belt means to fit various sized waists.

14. The safety apparatus of claim 13 wherein said first connection means comprises at least one D-ring.

15. The safety apparatus of claim 14 wherein said D-ring is secured to said first belt means at a central position with respect to the back of said person when said apparatus is worn by said person.

16. The safety apparatus of claim 1 wherein said second belt means is releasably held in said stowed position by second releasable securement means.

17. The safety apparatus of claim 16 wherein said second releasable securement means comprises a fastening system having at least one hook component and at least one loop component, with one component of said system being secured to said first belt means and with the other component being secured to said second belt means, said components being arranged to engage each other to hold the second belt means against said first belt means.

18. The safety apparatus of claim 17 wherein said strap-like members are initially held by first releasable securement means in a storage position on said apparatus until it is desired to connect said strap-like members to said lowering device, whereupon each of said members may be readily moved to an extended position so that the free ends thereof may be connected to said lowering device.

19. The safety apparatus of claim 18 wherein said first releasable securement means comprises a fastening system having at least one hook component and at least one loop component, with one component of said system being secured to the free end of each strap and with the other component being secured to said second belt means, said components being arranged to engage each other to hold the free end of each of said elongated strap-like members against said second belt means, thereby preventing said strap-like members from interfering with the activities of said person when said strap-like members are in the storage position.

20. The safety apparatus of claim 19 wherein said first belt means includes adjustment means to adjust the size of said belt to fit various sized waists.

21. The safety apparatus of claim 20 wherein said first connection means comprises at least one D-ring.

22. The safety apparatus of claim 21 wherein said D-ring is secured to said first belt means at a central position with respect to the back of said person when said apparatus is worn by said person.

23. The safety apparatus of claim 22 wherein said first and second belt means are each formed of a flexible fabric material.

24. The safety apparatus of claim 23 wherein said fabric material is nylon or polyester.

25. Belt apparatus to be worn by a person located at an elevated position for releasable securement to a first device mounted at an elevated position while enabling the person to repel down a safety line located adjacent said device, said safety line having a lowering device mounted thereon, said belt apparatus comprising first belt means and lowering device connection means, said first belt means being arranged to be releasably secured about the waist of the person and including first connection means for releasable securement to said first device, said lowering device connecting means comprising a pair of extendable, elongated strap-like members being fixedly secured to said first belt means at a respective spaced positions thereon, each of said strap-like members having a free end arranged to be readily connected to said lowering device for enabling said person to repel down on a safety line once said person has disconnected said first belt means from said holding device.

26. Belt apparatus of claim 25 wherein said extendable, elongated strap like members are initially held by first releasable securement means in a storage position on said apparatus until it is desired to connect said strap-like members to said lowering device, whereupon each of said members may be readily moved to an extended position so that the free ends thereof may be connected to said lowering device.

27. The safety apparatus of claim 26 wherein said first releasable securement means comprises a fastening system having at least one hook component and at least one loop component, said components being arranged to engage each other to hold the free end of each of said elongated strap-like members against said first belt means, thereby preventing said strap-like members from interfering with the activities of said person when said strap-like members are in the storage position.

28. The safety apparatus of claim 1 additionally comprising storage means secured thereto.

29. The safety apparatus of claim 28 wherein said storage means comprises a holster secured to one of said belt means.

* * * * *